US006332380B1

(12) United States Patent
Macor

(10) Patent No.: US 6,332,380 B1
(45) **Date of Patent: *Dec. 25, 2001**

(54) WRENCH WITH ERGONOMIC GRIPPING PORTION

(75) Inventor: Richard J. Macor, Hunterdon County, NJ (US)

(73) Assignee: Proprietary Technologies, Inc.

( * ) Notice: Subject to any disclaimer, the term of this patent is extended or adjusted under 35 U.S.C. 154(b) by 0 days.

This patent is subject to a terminal disclaimer.

(21) Appl. No.: 09/642,056

(22) Filed: Aug. 21, 2000

Related U.S. Application Data

(63) Continuation-in-part of application No. 09/027,918, filed on Feb. 23, 1998, which is a continuation-in-part of application No. 29/072,381, filed on Jun. 16, 1997, now Pat. No. Des. 402,867.

(51) Int. Cl.[7] ..... B25B 23/16

(52) U.S. Cl. ..... 81/177.1; 81/489; 81/60; 81/61; 81/63.2

(58) Field of Search ..... 81/177.1, 489, 81/60, 61, 63.2

(56) References Cited

U.S. PATENT DOCUMENTS

| | | | | |
|---|---|---|---|---|
| D. 42,321 | * | 3/1912 | Gilbert | 81/124.3 |
| 626,867 | * | 6/1899 | Mass | 81/489 |
| 1,424,045 | * | 7/1922 | Sprague | 81/177.1 |
| 1,506,331 | * | 8/1924 | Benko | 41/177.1 |
| 1,797,446 | * | 3/1931 | Salmon | 81/124.3 |
| 2,247,521 | * | 7/1941 | Pierce | 81/124.7 |
| 3,175,436 | * | 3/1965 | Coleman | 81/177 |
| 5,062,327 | * | 11/1991 | Hammons et al. | 81/124.3 |
| 5,884,539 | * | 3/1999 | Baker | 81/165 |
| 6,094,781 | * | 8/2000 | Jansson et al. | 16/431 |

* cited by examiner

*Primary Examiner*—Derris H. Banks
*Assistant Examiner*—Shantese McDonald

(57) ABSTRACT

A wrench is described for turning various fasteners. The wrench has a predetermined entire length and comprises a driving portion at one end thereof for turning various fasteners. The driving portion has a predetermined length and an axis of wrench rotation. The wrench also has a gripping portion at the other end thereof for gripping and operating the wrench. The gripping portion has dimensions of length greater than width, and width greater than thickness and is formed elliptically shaped as viewed from a top view thereof, and is formed elongated in shape as viewed from an end view thereof. The gripping portion is further formed with a length relative to the entire length of the wrench and the length of the driving portion, whereas, the length of the gripping portion is about equal to, the entire length of the wrench less the length of the driving portion.

19 Claims, 2 Drawing Sheets

WRENCH WITH ERGONOMIC GRIPPING PORTION

This application is a continuation-in-part of U.S. patent application Ser. No. 09/027,918 filed on Feb. 23, 1998, by the inventor herein, entitled WRENCH GRIP, of which, was a continuation-in-part of U.S. patent application Ser. No. 29/072,381, filed on Jun. 16, 1997, entitled RATCHET WRENCH which is now U.S. Pat. No. D402,867. Other related patents issued and filed by the inventor herein, include U.S. Pat. No. D411,791; U.S. Pat. No. D411,792; and, U.S. Pat. No. 6,003,413.

FIELD OF THE INVENTION

The present invention relates to hand tools, particularly wrenches and more particularly ratcheting and adjustable type wrenches. The present invention may also apply to other known wrenches including open end, box end, flare nut, etc.

BACKGROUND OF THE INVENTION

Typically, most wrenches have handles or gripping portions which are relatively thin. Accordingly, the gripping portions of most wrenches tend to promote user discomfort and fatigue. In addition, most wrenches have relatively long handles or gripping portions which detract from the balance and control of the tool. There have been some attempts to improve wrench comfort, balance and control, however, most attempts have included the use of a wrench grip derived from other applications thereby minimizing the affect of any improvement.

SUMMARY OF THE INVENTION

The present invention involves a unique wrench with an elliptically shaped gripping means that is formed with critical features and dimensional relationships which significantly affect the comfort, balance, torque and control of the wrench.

More particularly, the present invention involves a wrench for turning nuts, bolts and various fasteners. The wrench has a predetermined entire length and comprises a wrench head or driving portion which has a predetermined length and an axis of wrench rotation, and, a gripping portion which has dimensions of length greater than width, and width greater than thickness. The gripping portion is formed elliptically shaped as viewed from a top view and elongated in shape as viewed from an end view. The gripping portion is further formed with a length relative to the entire length of the wrench and the length of the wrench head, whereas, the length of the gripping portion is about equal to, the entire length of the wrench minus the length of the wrench head. Preferred embodiments of the present invention include a ratchet wrench with a ratcheting mechanism in the wrench head, and, an adjustable type wrench with an adjustable, open ended wrench head.

The present invention has been developed recognizing the deficiencies of known wrenches including lack of comfort, torque capacity, balance and control.

Accordingly, it is an important objective of the present invention described above to provide for a wrench with a unique gripping portion that can enhance comfort, so that a user may attain higher levels of torque than that of a standard wrench of equal or greater size.

It is another objective of the present invention described above to provide for a wrench with a unique gripping portion that can enhance balance and control.

It is another objective of the present invention that it be commercially viable, simple in design, and cost efficient to manufacture.

DETAILED DESCRIPTION OF THE DRAWINGS

The present invention can be applicable to almost any wrench including but not limited to ratchet wrenches, adjustable wrenches, open end wrenches, box wrenches, flex "T" handle wrenches and the like. Applicant contemplates preferred embodiments of the present invention to include the ratchet and adjustable type wrenches. The present invention includes a unique, elliptically shaped gripping means that is formed with critical features and dimensional relationships. The rather short and wide or "stubby" wrench grip of the present invention can have a significant positive affect on comfort, torque, balance and control, all simultaneously. When referring to a "gripping means" applicant is also referring to a "gripping portion" or a "wrench grip;" and, when referring to a "gripping portion" applicant is also referring to a "gripping means" or "wrench grip."

Figure 1:
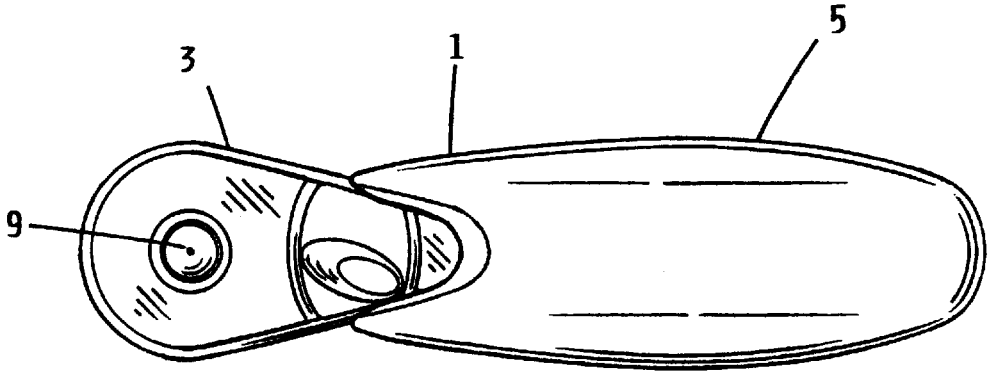
FIG. 1 shows a top plan view of a present invention ratchet type wrench with an ergonomic, gripping portion.

Referring now to the drawings which are for the purpose of illustrating preferred embodiments of the present invention and not for the purpose of limiting same, FIG. 1 shows a top plan view of a present invention ratchet type wrench 1, with wrench head 3, wrench gripping portion 5 and wrench axis of wrench rotation 9. Here it is easy to see that ratchet wrench 1 has a unique, distinctive shape with the gripping portion 5 being formed longer than it is wide and elliptically shaped. The elliptically shaped portion 5 is important because it provides a significant level of ergonomics for the application. In this FIG. 1, it is easy to see that the length of gripping means 5 combined with the length of wrench head 3 is about equal to the entire length of wrench 1. Therefore, gripping means 5 has a length about equal to the entire length of the wrench 1 shown, minus the length of the wrench head 3. This is also important because such an arrangement provides for a "stubby" type wrench that does not have a distinctly different wrench area between wrench head 3 and wrench gripping portion 5. Therefore, the present invention particularly involves a wrench that has a gripping portion which has a defined dimensional relationship to the wrench and wrench head, combined with, a defined elliptical shape.

Figure 2:
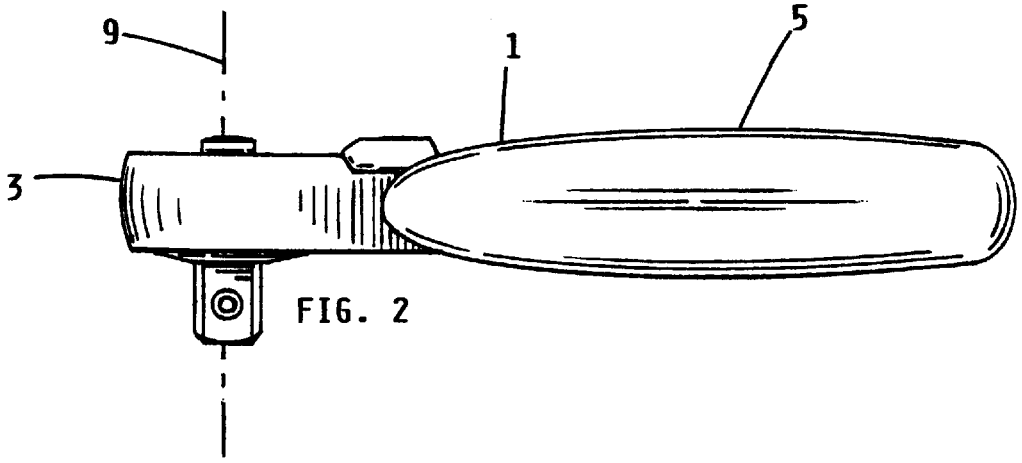
FIG. 2 shows a left side, elevation view of the present invention ratchet wrench shown in FIG. 1.

FIG. 2 shows a left side, elevation view of the present invention ratchet wrench shown in FIG. 1, with wrench head 3, gripping portion 5 and wrench axis of rotation 9. When viewing both FIGS. 1 and 2 together, it is easy to see that gripping means 5 is formed having dimensions of length greater than width, and width greater than thickness or height. Again, it is easy to see that gripping portion 5 has a length about equal to the entire length of the wrench 1 shown, minus the length of the wrench head 3.

Figure 3:
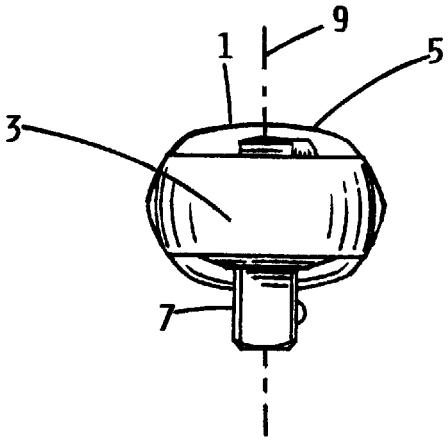
FIG. 3 shows a front, elevation view of the present invention ratchet wrench shown in FIGS. 1 and 2.
Figure 4:
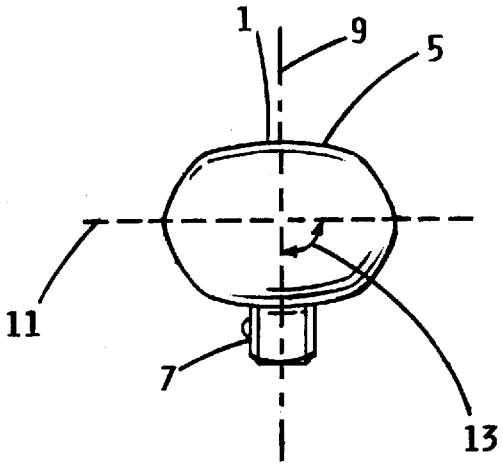
FIG. 4 shows a rear, elevation view of the present invention ratchet wrench shown in FIGS. 1, 2 and 3; and, FIG. 5 shows a top plan view of a present invention adjustable type wrench with an ergonomic, gripping means.

Referring now to both FIGS. 3 and 4 together, there is shown a front elevation view and a rear (or end) elevation view respectively, of the present invention ratchet wrench shown in FIGS. 1 and 2. Ratchet wrench 1 has wrench head 3, gripping means 5, wrench driving element 7 and axis of wrench rotation 9. The axis of wrench rotation 9 is the imaginary axis about which the wrench head rotates when loosening or tightening various fasteners. FIG. 4 shows that gripping means 5 is elongated as viewed from an end view, and this elongation which is represented by imaginary line 11 is about perpendicular to the axis of wrench rotation 9. Accordingly, the angle at reference line 13 is about 90 degrees. This elongation and alignment of the gripping portion to the wrench and axis of wrench rotation is also important because such an arrangement can communicate (by feel) the axis of wrench rotation to a user so that the user may apply force to the gripping portion at the most efficient angle, even without looking at the wrench.

Figure 5:
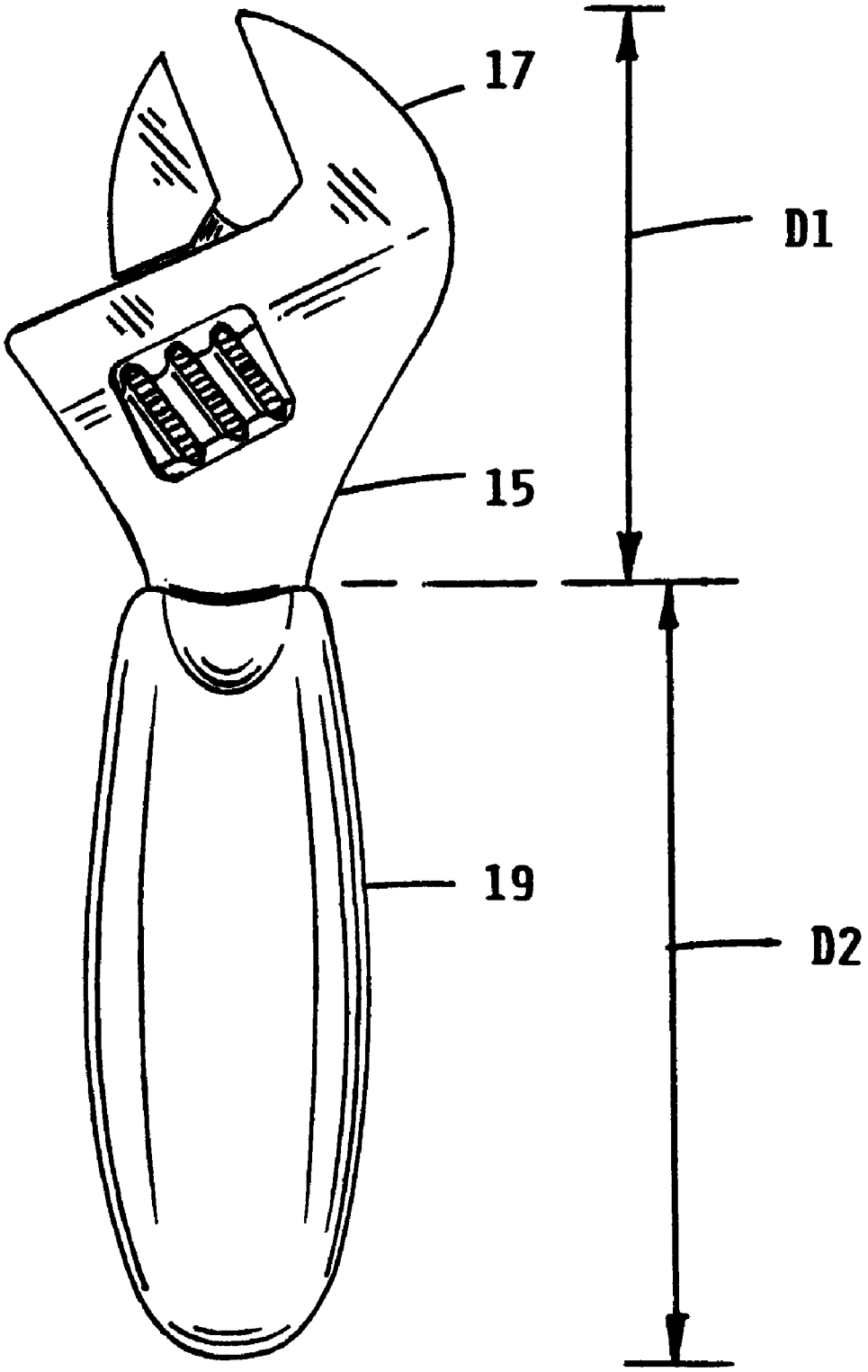

FIG. 5 shows a top plan, view of a present invention adjustable type wrench with an ergonomic, gripping means or gripping portion similar to that shown in previous views. Here wrench 15 has wrench head 17 having a length dimension D1 and wrench gripping means 19 having a length dimension D2. Here it is easy to see that gripping means 19 is elliptically shaped and has a length dimension D2 which when combined with dimension D1 (the length of wrench head 17) is about equal to the entire length of wrench 15 as shown. Therefore, Gripping means 19 has a length dimension D2 which is about equal to the entire length of wrench 15 (D1+D2) minus dimension D1 the length of wrench head 17. It can clearly be seen that the length D2 of the gripping portion 19, is greater than half the entire length of wrench 15 (D1+D2). Again this provides for a "stubby" ergonomic wrench with superior comfort, torque, balance and control.

Upon reading and understanding the specification of the present invention described above, modifications and alterations will become apparent to those skilled in the art. It is intended that all such modifications and alterations be included insofar as they come within the scope of the patent as claimed or the equivalence thereof.

Having thus described the invention, the following is claimed:

1. A wrench for turning various fasteners, said wrench having a predetermined entire length and comprising:

a driving portion at one end thereof for turning said various fasteners, said driving portion having a predetermined length and an axis of wrench rotation; and, a gripping portion at the other end thereof for gripping and operating said wrench, said gripping portion having dimensions of length greater than width, and width greater than thickness and being formed elliptically shaped as viewed from a top view thereof and being formed elongated in shape as viewed from an end view thereof, and, said gripping portion further being formed with a length relative to the entire length of said wrench and the length of said driving portion, whereas, the length of said gripping portion is about equal to, the entire length of said wrench less the length of said driving portion.

2. A wrench of claim 1, wherein said gripping portion is aligned relative to said driving portion as viewed from an end view thereof, whereas, the elongation of said gripping portion is aligned substantially perpendicular to said axis of wrench rotation.

3. A wrench of claim 2, wherein said wrench is a ratchet wrench, and said driving portion has a ratcheting mechanism therein.

4. A wrench of claim 2, wherein said wrench is an adjustable type wrench, and said driving portion is open ended and adjustable.

5. A wrench of claim 1, wherein the length of said gripping portion is greater than 50% the entire length of said wrench.

6. A wrench of claim 5, wherein said wrench is a ratchet wrench, and said driving portion has a ratcheting mechanism therein.

7. A wrench of claim 5, wherein said wrench is an adjustable type wrench, and said driving portion is open ended and adjustable.

8. A wrench of claim 1, wherein said wrench is a ratchet wrench, and said driving portion has a ratcheting mechanism therein.

9. A wrench of claim 1, wherein said wrench is an adjustable type wrench, and said driving portion is open ended and adjustable.

10. A gripping means for a wrench, said wrench having a predetermined entire length and comprising a driving portion at one end, and said gripping means at the other end thereof; said driving portion having a predetermined length and an axis of wrench rotation, said gripping means being formed for gripping and operating said wrench, said gripping means having dimensions of length greater than width, and width greater than thickness and being formed elliptically shaped as viewed from a top view thereof and being formed elongated in shape as viewed from an end view thereof, and, said gripping means further being formed with a length relative to the entire length of said wrench and the length of said driving portion, whereas, the length of said gripping means is about equal to, the entire length of said wrench less the length of said driving portion.

11. A gripping means of claim 10, wherein said gripping means is aligned relative to said driving portion as viewed from an end view thereof, whereas, the elongation of said gripping means is aligned substantially perpendicular to the axis of wrench rotation.

12. A gripping means of claim 11, wherein said wrench is a ratchet wrench, and said driving portion has a ratcheting mechanism therein.

13. A gripping means of claim 11, wherein said wrench is an adjustable type wrench, and said driving portion is open ended and adjustable.

14. A gripping means of claim 10, wherein the length of said gripping means is greater than 50% the entire length of said wrench.

15. A gripping means of claim 14, wherein said wrench is a ratchet wrench, and said driving portion has a ratcheting mechanism therein.

16. A gripping means of claim 14, wherein said wrench is an adjustable type wrench, and said driving portion is open ended and adjustable.

17. A gripping means of claim 10, wherein said wrench is a ratchet wrench, and said driving portion has a ratcheting mechanism therein.

18. A gripping means of claim 10, wherein said wrench is an adjustable type wrench, and said driving portion is open ended and adjustable.

19. A wrench for turning various fasteners, said wrench having a predetermined entire length and comprising a driving portion at one end and a gripping portion at the other end thereof, said driving portion having a predetermined length and an axis of wrench rotation, said gripping portion having dimensions of length greater than width, and width greater than thickness and being formed elliptically shaped as viewed from a top view thereof and being formed elongated in shape as viewed from an end view thereof, and, said gripping portion further being formed with a length relative to the entire length of said wrench, whereas, the length of said gripping portion is equal to or greater than 55% the entire length of said wrench.

* * * * *